US006407647B1

(12) United States Patent
Apel et al.

(10) Patent No.: US 6,407,647 B1
(45) Date of Patent: Jun. 18, 2002

(54) INTEGRATED BROADSIDE COUPLED TRANSMISSION LINE ELEMENT

(75) Inventors: Thomas R. Apel; Richard L. Campbell, both of Portland, OR (US)

(73) Assignee: TriQuint Semiconductor, Inc., Hillsboro, OR (US)

( * ) Notice: Subject to any disclaimer, the term of this patent is extended or adjusted under 35 U.S.C. 154(b) by 0 days.

(21) Appl. No.: 09/768,865

(22) Filed: Jan. 23, 2001

(51) Int. Cl.[7] ..... H01P 5/10
(52) U.S. Cl. ..... 333/25; 333/33; 336/200
(58) Field of Search ..... 333/25, 26, 33; 336/200, 230

(56) References Cited

U.S. PATENT DOCUMENTS

| | | | | | |
|---|---|---|---|---|---|
| 4,992,769 | A | * | 2/1991 | Oppelt et al. | 336/180 |
| 4,999,597 | A | * | 3/1991 | Gaynor | 333/246 |
| 5,200,718 | A | * | 4/1993 | Kato | 333/25 |
| 5,430,424 | A | * | 7/1995 | Sato et al. | 336/200 |
| 5,852,866 | A | * | 12/1998 | Kuettner et al. | 29/608 |
| 5,884,990 | A | * | 3/1999 | Burghartz et al. | 336/200 |
| 6,097,273 | A | * | 8/2000 | Frye et al. | 336/200 |

* cited by examiner

*Primary Examiner*—Robert Pascal
*Assistant Examiner*—Dean Takaoka
(74) *Attorney, Agent, or Firm*—Skjerven Morrill LLP

(57) ABSTRACT

A novel broadside-coupled transmission line element is disclosed. The element includes a first metallization layer that has a first spiral-shaped transmission line and at least one bridge segment formed therein. The element also includes a second metallization layer that has a second spiral-shaped transmission line and connector segments formed therein. The connector segments provide respective electrical conduction paths between the inner area of the first and second transmission lines and the outer area of the first and second transmission lines. A first one of the connector segments is electrically connected to the inner terminus of the second transmission line. The second transmission line has a gap at each intersection with the connector segments. A dielectric layer lies between the first and second metallization layers. The dielectric layer has a plurality of apertures formed therein for providing electrical connections between the second transmission line and the bridge segment(s) of the first metallization layer, and for providing an electrical connection between the inner terminus of the first transmission line and a second one of the connector segments. The element is realized in an integrated circuit environment, and may be used to create various circuit elements such as baluns, balanced and unbalanced transformers and current and voltage inverters for operation at high frequencies.

14 Claims, 7 Drawing Sheets

INTEGRATED BROADSIDE COUPLED TRANSMISSION LINE ELEMENT

TECHNICAL FIELD OF THE INVENTION

The present invention relates to impedance transforming elements, and in particular to an integrated broadside coupled transmission line element.

BACKGROUND OF THE INVENTION

The use of twisted pairs of copper wires to form coupled transmission line elements is well known. These transmission line elements may be used to create baluns, balanced and unbalanced transformers and current and voltage inverters. Examples of the use of conventional transmission line elements are presented in C. L. Ruthroff, "Some Broad-Band Transformers," *Proceedings of the IRE* (*Institute for Radio Engineers*), vol. 47, pp. 1337–1342 (August 1959), which is incorporated herein by reference. These transmission line elements are typically found in forms that are useful in frequency bands through UHF.

The use of such transmission line elements in integrated circuits such as RF power amplifiers and low noise amplifiers that operate at higher frequencies is desirable. However, the incorporation of numerous off-chip devices such as these conventional transmission line elements into RF devices such as cellular telephones is not competitive due to size and cost. Moreover, conventional coupled transmission line elements are not suitable for use in the desired frequency range.

SUMMARY OF THE INVENTION

Therefore, a need has arisen for a coupled transmission line element that addresses the disadvantages and deficiencies of the prior art. In particular, a need has arisen for a integrated broadside-coupled transmission line element.

Accordingly, a novel broadside-coupled transmission line element is disclosed. In one embodiment, the element includes a first metallization layer that has a first spiral-shaped transmission line and at least one bridge segment formed therein. The element also includes a second metallization layer that has a second spiral-shaped transmission line and connector segments formed therein. The connector segments provide respective conduction paths between the inner area of the first and second transmission lines and the outer area of the first and second transmission lines. A first one of the connector segments is electrically connected to the inner terminus of the second transmission line. The second transmission line has a gap at each intersection with the connector segments. A dielectric layer lies between the first and second metallization layers. The dielectric layer has a plurality of apertures formed therein for providing electrical connections between the second transmission line and the bridge segment(s) of the first metallization layer, and for providing an electrical connection between the inner terminus of the first transmission line and a second one of the connector segments.

An advantage of the present invention is that a coupled transmission line element may be realized in an integrated circuit environment. Another advantage of the present invention is that the element may be used to create various circuit elements such as baluns, balanced and unbalanced transformers, power splitters, combiners, directional couplers and current and voltage inverters. Yet another advantage is that the element may be used at higher signal frequencies than conventional non-integrated coupled transmission line elements.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION OF THE INVENTION

The preferred embodiments of the present invention and their advantages are best understood by referring to FIGS. 1 through 12 of the drawings. Like numerals are used for like and corresponding parts of the various drawings.

Figure 1:
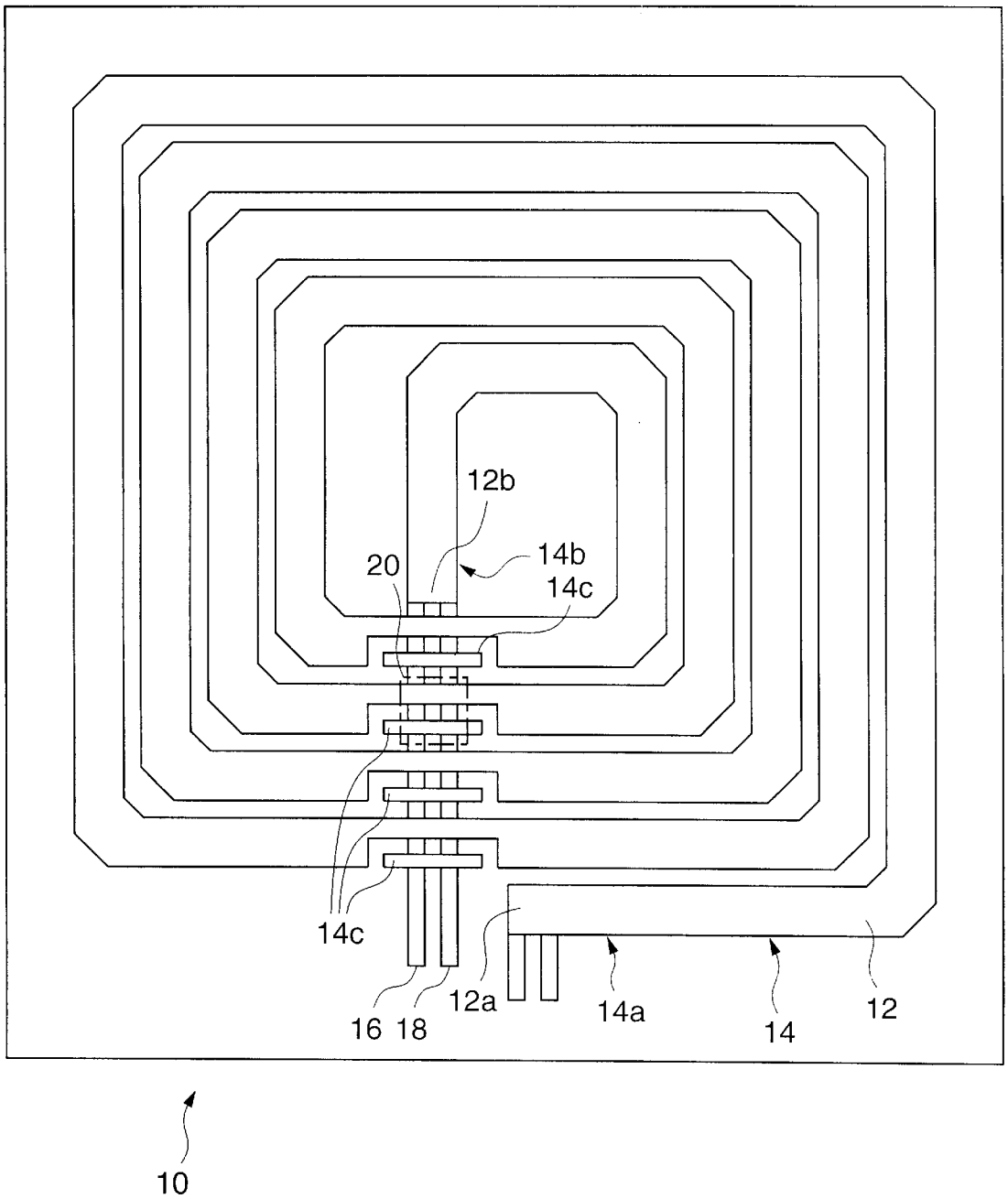
FIG. 1 is a top view of a rectangular spiral broadside-coupled transmission line element.

Referring to FIG. 1, a top view of a rectangular spiral broadside-coupled transmission line element 10 is shown. In element 10, an upper transmission line 12 primarily occupies an upper metallization layer. A lower transmission line 14 primarily occupies a lower metallization layer underneath the upper metallization layer. The upper and lower metallization layers are separated by a dielectric layer (not shown in FIG. 1). Each transmission line 12, 14 has an outer terminus 12*a*, 14*a*. From the outer terminus 12*a*, 14*a*, each transmission line 12, 14 spirals inward to an inner terminus 12*b*, 14*b*.

At the inner terminus 12*b*, 14*b*, each transmission line 12, 14 is electrically connected to a respective connector 16, 18. In one embodiment, connectors 16 and 18 reside in the lower metallization layer. Connectors 16 and 18 are used to establish electrical contact between the respective inner termini 12*b*, 14*b* and other electrical terminals.

Each loop of the spiral element 10 requires transmission lines 12 and 14 to cross over connectors 16 and 18. To accomplish this without the use of an additional metallization layer, a bridge segment 14*c* of transmission line 14 shares space in the upper metallization layer with transmission line 12 in a crossover area 20.

The transmission lines of element 10 are referred to as "broadside-coupled" because the transmission lines are vertically aligned, giving rise to transmission line coupling between the conductors. Naturally, other effects such as edge coupling between conductor loops within the same metallization layer are also observed. However, the spiral shape of transmission lines 12 and 14 allows the transmission line coupling to predominate over other undesired effects.

Various shapes other than a rectangular spiral shape are possible for element 10. For example, a "meander" shape, eliminating the need for crossover areas such as crossover area 20, may be used. However, the meander shape gives rise to edge coupling effects which detract from the transmission line coupling between the conductors.

Figure 2:
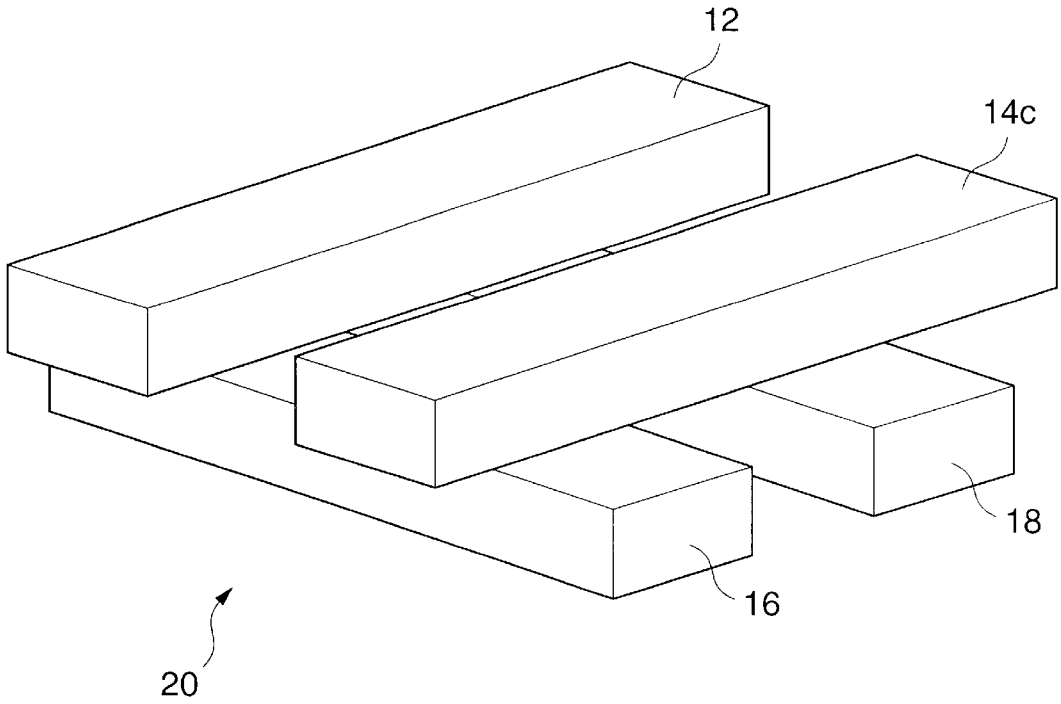
FIG. 2 is a perspective view of a crossover area in the transmission line element.

Referring to FIG. 2, a perspective view of a crossover area 20 is shown. Transmission line 12 and bridge segment 14*c* occupy the upper metallization layer while connectors 16 and 18 occupy the lower metallization layer. A dielectric layer (not shown) separates the two metallization layers.

Figure 3A:
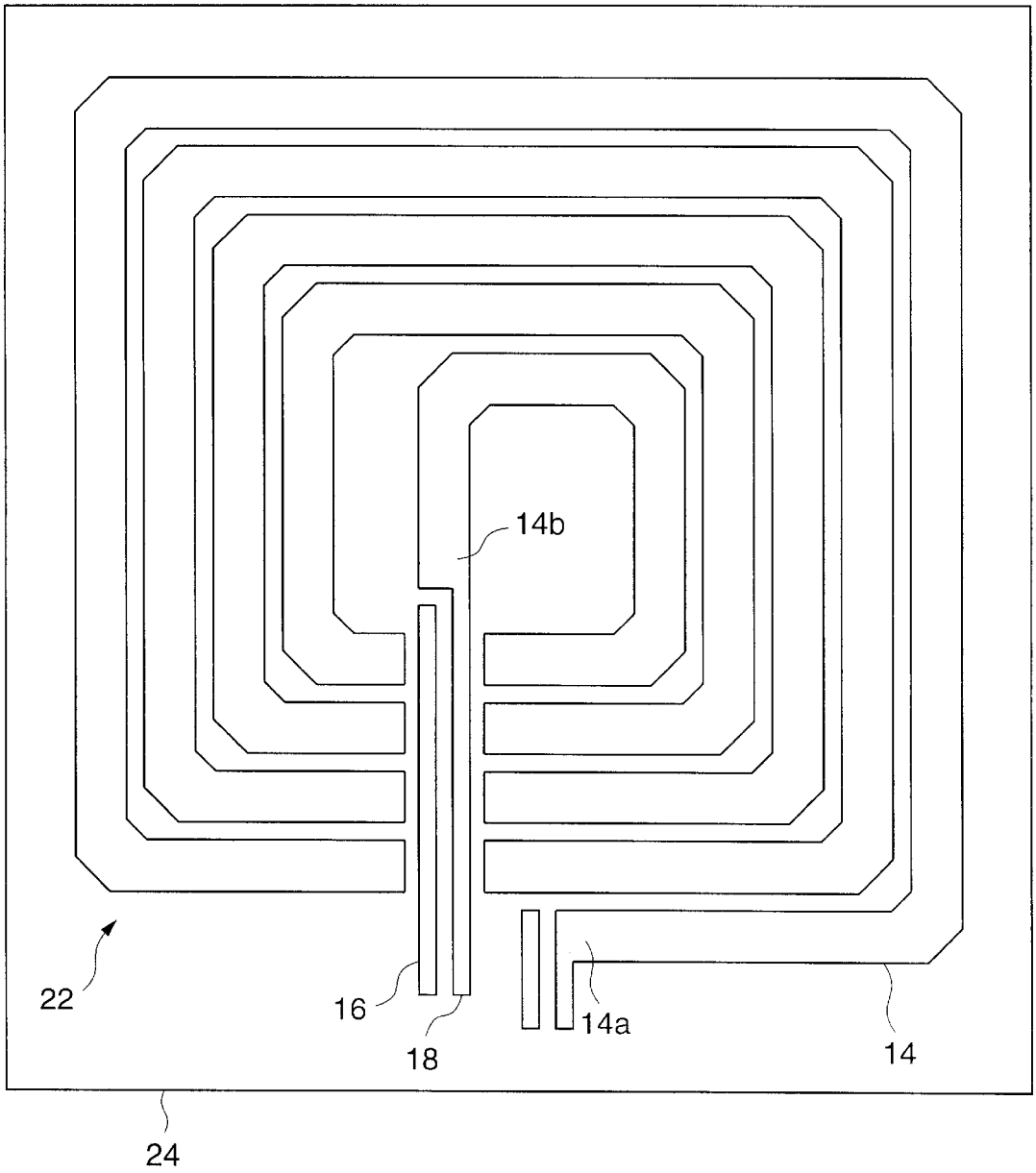
FIGS. 3A through 3C are top views of the transmission line element at various stages of fabrication.
Figure 3B:
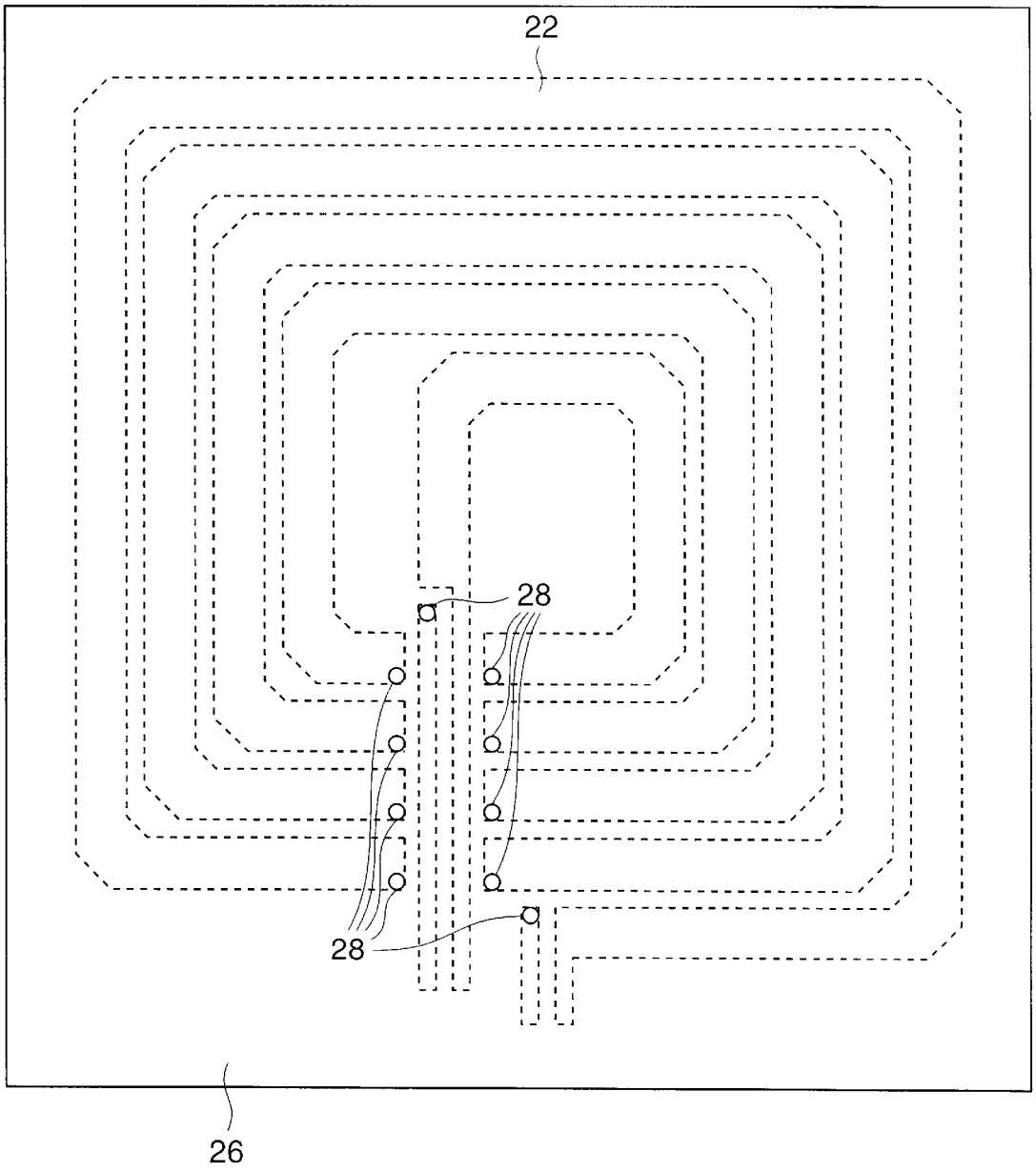
Figure 3C:
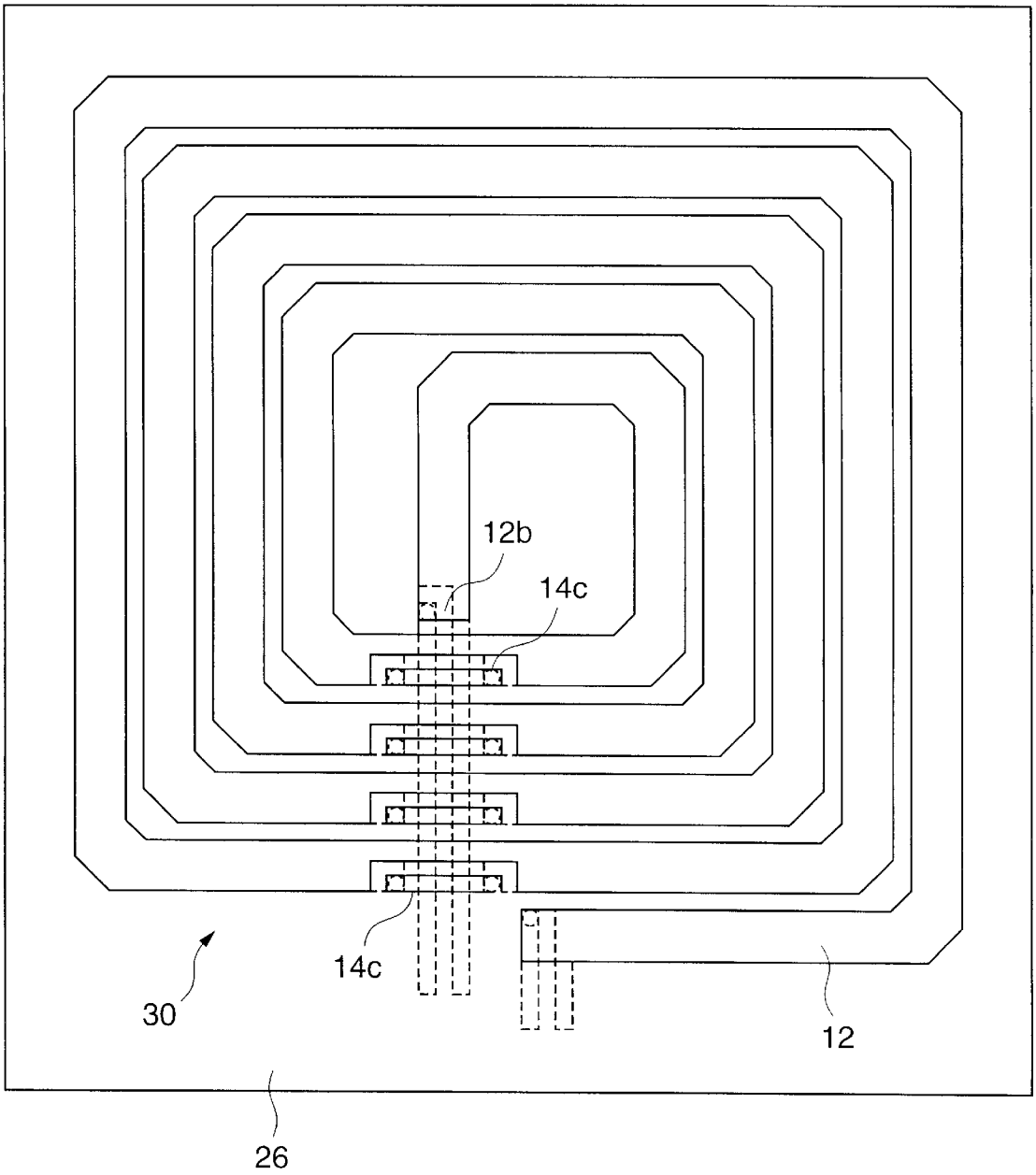

A process for creating element 10 is illustrated in FIGS. 3A through 3C, where top views of element 10 at various stages of fabrication are shown. Referring to FIG. 3A, the pattern of the lower metallization layer 22 is shown. Metallization layer 22 may be, for example, a layer of aluminum, gold, or another conductive material. Metallization layer 22 is deposited on a substrate 24 and photolithographically patterned to create transmission line 14 and connectors 16 and 18 using conventional semiconductor fabrication techniques. Substrate 24 may be gallium arsenide, silicon or some other conventional substrate material.

Referring to FIG. 3B, a dielectric layer 26 is deposited over metallization layer 22 and substrate 24. Dielectric layer 26 may be, for example, bisbenzocyclobutene (BCB), a nitride or oxide of silicon, or some other insulating material. Dielectric layer 26 is deposited using conventional techniques. Vias 28 are formed in dielectric layer 26 using conventional photolithography techniques. Vias 28 are formed in the locations shown to establish electrical contacts between the two metallization layers.

Referring to FIG. 3C, the upper metallization layer 30 is formed over dielectric layer 26. Metallization layer 30 may be, for example, a layer of aluminum, gold, or another conductive material. Metallization layer 30 is deposited on dielectric layer 26 and photolithographically defined to create transmission line 12 and bridge segments 14*c* of transmission line 14, exclusive of a via, using conventional semiconductor fabrication techniques. During deposition, metallization layer 30 fills in the vias in dielectric layer 26, establishing electrical contact to metallization layer 22.

The dimensions of element 10 are preferably such that each transmission line 12, 14 has an overall length that is less than or approximately equal to one-eighth of the signal wavelength. The lower limit of transmission line length will vary depending on device characteristics, but is generally determined by transmission line coupling. In general, it is preferable for the desired "odd mode" or differential coupling between the transmission lines to predominate over the undesired "even mode" or "common mode" of signal propagation with respect to ground or "common terminal," as is known to those skilled in the art.

In one exemplary embodiment, signals in the frequency range of 1 GHz to 5 GHz are to be conducted by element 10. In this embodiment, each transmission line 12, 14 has a width of 15 microns, a thickness of five microns, and an overall length of four millimeters. Transmission lines 12, 14 are separated by a dielectric layer with a thickness of 1.5 microns.

Spiral element 10 may be used to create known circuit devices created using conventional coupled transmission lines, such as a twisted pair of copper wires. For example, spiral element 10 may be used to create baluns, balanced and unbalanced transformers and current and voltage inverters.

Various examples of these circuit devices are shown in FIGS. 4 through 12, in which coupled transmission lines are represented by parallel inductors. In these figures, the outer termini of the respective transmission lines are represented, for example, on the left side of each figure, while the inner termini of the respective transmission lines are represented on the right side of each figure. It will be understood that the opposite configurations are equally feasible, in which the outer termini of the respective transmission lines are represented on the right side of each figure, while the inner termini of the respective transmission lines are represented on the left side of each figure.

In FIGS. 4 through 12, the upper and lower inductors may represent the upper and lower transmission lines 12 and 14, respectively, shown in the previous figures. Of course, the opposite arrangement is also feasible. In a few cases, more than one broadside-coupled transmission line element such as that shown in FIG. 1 is used.

In FIGS. 4 through 12, a "balanced" or "unbalanced" circuit element or set of conductors is connected to each side (right and left) of the circuit device (e.g., transformer or balun) depicted. An unbalanced element may be, for example, a coaxial cable, so that one device terminal is connected to the center conductor of the cable while the other device terminal is connected to the (grounded) shield of the cable. A balanced element may be, for example, a twisted pair of copper wires. Of course, other balanced and unbalanced circuit elements may be used.

Figure 4:
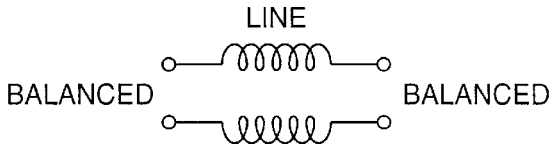
FIG. 4 is a schematic diagram of a transmission line element designed in accordance with the present invention.
Figure 5:
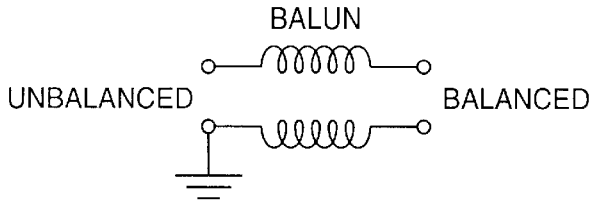
FIG. 5 is a schematic diagram of a balun using the transmission line element.
Figure 6:
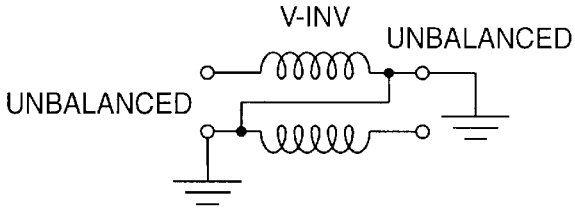
FIG. 6 is a schematic diagram of a voltage inverter using the transmission line element.
Figure 7:
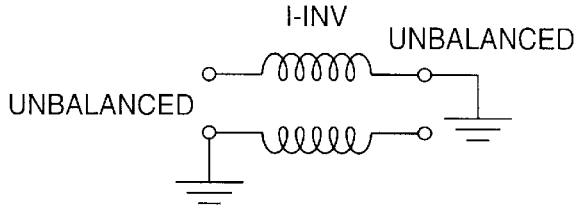
FIG. 7 is a schematic diagram of a current inverter configuration using the transmission line element.
Figure 8:
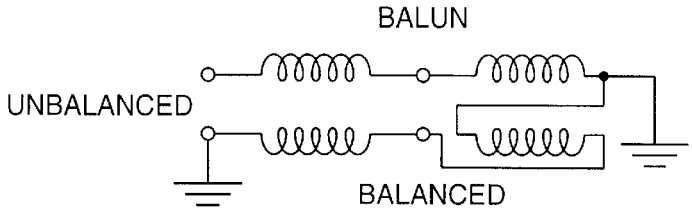
FIG. 8 is a schematic diagram of a second balun configuration using the transmission line element.
Figure 9:
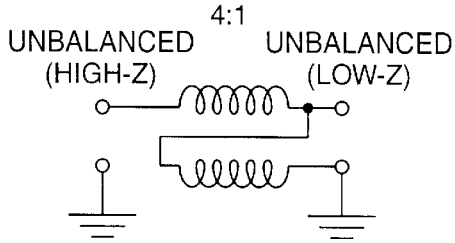
FIG. 9 is a schematic diagram of a 4:1 unbalanced transformer using the transmission line element.
Figure 10:
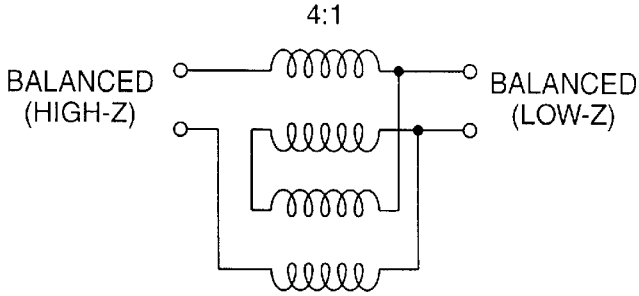
FIG. 10 is a schematic diagram of a 4:1 balanced transformer using the transmission line element.
Figure 11:
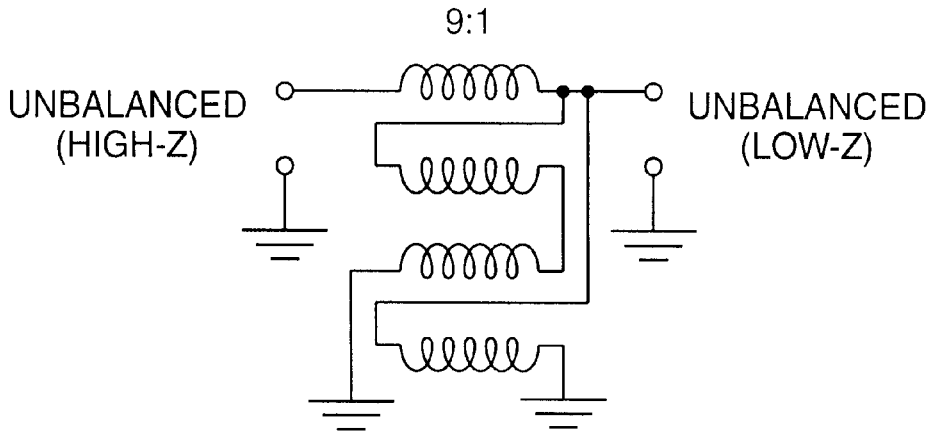
FIG. 11 is a schematic diagram of a 9:1 unbalanced transformer using the transmission line element.
Figure 12:
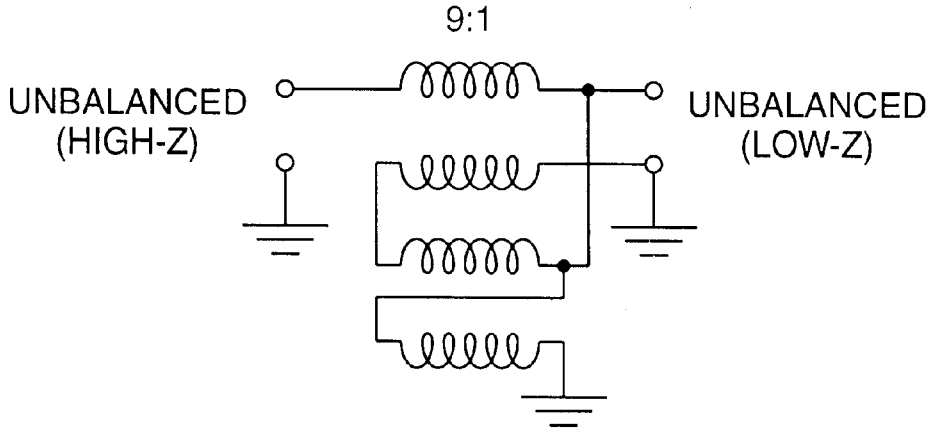
FIG. 12 is a schematic diagram of a second 9:1 unbalanced transformer configuration using the transmission line element.

With the foregoing explanation in mind, the configurations of FIGS. 4 through 12 are self-explanatory. Referring to FIG. 4, a basic transmission line element such as that previously described is shown. In FIG. 5, a balun is shown. In FIG. 6, a voltage-inverting configuration is shown. In FIG. 7, a current-inverting configuration is shown. In FIG. 8, a second balun configuration is shown. In FIG. 9, a 4:1 unbalanced transformer is shown. In FIG. 10, a 4:1 balanced transformer is shown. In FIG. 11, a 9:1 unbalanced transformer is shown. In FIG. 12, a second 9:1 unbalanced transformer configuration is shown. Each of these configurations may be created using one or more spiral elements such as spiral element 10. Other variations and combinations of these elements may be readily conceived by those skilled in the art.

Although the present invention and its advantages have been described in detail, it should be understood that various changes, substitutions, and alterations can be made therein without departing from the spirit and scope of the invention as defined by the appended claims.

We claim:

1. A method for creating a transmission line element, comprising the acts of:

defining a first electrically conductive transmission line in a first metal layer, wherein the first transmission line comprises a plurality of segments and spirals outward from an inner terminus;

forming a dielectric over the first metal layer;

defining a second electrically conductive transmission line in a second metal layer formed over the dielectric, wherein the second transmission line spirals outward from an inner terminus, and wherein the second transmission line is positioned over the first transmission line;

defining a bridge segment in the second metal layer, the bridge segment forming an electrical connection, exclusive of a via, between first and second segments of the first transmission line; and defining a first connector segment in the first metal layer, wherein the first connector segment extends from the inner terminus of the first transmission line, below the bridge segment, and between the first and second segments of the first transmission line.

2. The method of claim 1 further comprising the act of providing an electrical connection between the first connector segment and an outer terminus of the second transmission line.

3. The method of claim 1 further comprising the act of coupling the first transmission line and the second transmission line such that the line element functions in an electrical circuit as a balun, a voltage inverter, a current inverter, or a transformer.

4. The method of claim 1 further comprising the act of forming the second transmission line to have a length less than or approximately equal to one-eighth of a length of a signal to be received by the line element.

5. The method of claim 1 further comprising the acts of:

defining a second connector segment in the first metal layer, wherein the second connector segment extends below the bridge segment, and between the first and second segments of the first transmission line; and electrically connecting the second connector segment to the inner terminus of the second transmission line.

6. The method of claim 5 further comprising the act of providing an electrical connection between the second connector segment and an outer terminus of the first transmission line.

7. A balun comprising:

a first metallization layer having first and second spiral-shaped transmission lines, the first and second transmission lines each having an outer terminus and an inner terminus;

a second metallization layer having third and fourth spiral-shaped transmission lines and a plurality of connector segments formed therein, the third and fourth transmission lines each having an outer terminus and an inner terminus, the third and fourth transmission lines being substantially aligned with the first and second transmission lines, respectively, an unbalanced element having a conductor;

a balanced element having first and second conductors;

a third conductor providing an electrical connection between the conductor of the unbalanced element and a first selected one of the termini of the first transmission line;

a fourth conductor providing an electrical connection between a common potential and a first selected one of the termini of the third transmission line;

a fifth conductor providing an electrical connection between a first selected one of the termini of the second transmission line and a second selected one of the termini of the first transmission line;

a sixth conductor providing an electrical connection between a first selected one of the termini of the fourth transmission line and a second selected one of the termini of the third transmission line;

a seventh conductor providing an electrical connection between a second selected one of the termini of the second transmission line and a second selected one of the termini of the fourth transmission line;

an eighth conductor providing an electrical connection between a common potential and the second selected one of the termini of the second transmission line;

a ninth conductor providing an electrical connection between the second selected one of the termini of the first transmission line and the first conductor of the balanced element; and a tenth conductor providing an electrical connection between the second selected one of the termini of the third transmission line and the second conductor of the balanced element.

8. A transmission line element comprising:

a first electrically conductive transmission line defined in a first metal layer, wherein the first transmission line comprises a plurality of segments and spirals outward from an inner terminus;

a dielectric formed over the first metal layer;

a second electrically conductive transmission line defined in a second metal layer formed over the dielectric, wherein the second transmission line spirals outward from an inner terminus, and wherein the second transmission line is positioned over the first transmission line;

a bridge segment defined in the second metal layer, the bridge segment forming an electrical connection, exclusive of a via, between first and second segments of the first transmission line; and a first connector segment defined in the first metal layer, wherein the first connector segment extends from the inner terminus of the first transmission line, below the bridge segment, and between the first and second segments of the first transmission line.

9. The line element of claim 8 further comprising an electrical connection between the first connector segment and an outer terminus of the second transmission line.

10. The line element of claim 8 wherein the first transmission line comprises an outer terminus and the second transmission line comprises an outer terminus, and wherein at least one of the inner termini or outer termini are coupled to ground.

11. The line element of claim 8 wherein a length of the second transmission line is less than or approximately equal to one-eighth of a wavelength of a signal received by the line element.

12. The line element of claim 8 wherein the first transmission line and the second transmission line are each electrically coupled such that the line element functions in an electrical circuit as a balun, a voltage inverter, a current inverter, or a transformer.

13. The line element of claim 8 further comprising a second connector segment defined in the first metal layer, the second connector segment being electrically connected to the inner terminus of the second transmission line, and wherein the second connector segment extends below the bridge segment, and between the first and second segments of the first transmission line.

14. The line element of claim 13 further comprising an electrical connection between the second connector segment and an outer terminus of the first transmission line.

* * * * *